US006377760B1

(12) United States Patent
Hagiwara

(10) Patent No.: US 6,377,760 B1
(45) Date of Patent: Apr. 23, 2002

(54) TONER CONCENTRATION MEASURING APPARATUS

(75) Inventor: Yoshihiro Hagiwara, Niigata (JP)

(73) Assignee: Fuji Xerox Co., Ltd. (JP)

( * ) Notice: Subject to any disclaimer, the term of this patent is extended or adjusted under 35 U.S.C. 154(b) by 0 days.

(21) Appl. No.: 09/549,977

(22) Filed: Apr. 14, 2000

(30) Foreign Application Priority Data

Apr. 16, 1999 (JP) ..... 11-109543

(51) Int. Cl.[7] ..... G03G 15/08; G03G 15/10
(52) U.S. Cl. ..... 399/30; 399/57; 399/64
(58) Field of Search ..... 399/30, 57, 58, 399/61, 62, 64, 65

(56) References Cited

U.S. PATENT DOCUMENTS 3,635,373 A * 1/1972 Kuhl et al. ..... 399/30
3,876,116 A * 4/1975 Kushima et al. ..... 399/57
3,926,145 A * 12/1975 Muth ..... 399/64
3,994,257 A * 11/1976 Komori et al. ..... 399/57
4,008,612 A * 2/1977 Nagaoka et al. ..... 399/57 X
4,166,702 A * 9/1979 Okamoto et al. ..... 399/57
4,671,309 A * 6/1987 Iemura et al. ..... 399/57
5,899,605 A * 5/1999 Caruthers, Jr. et al. ... 399/57 X
5,905,510 A * 5/1999 Hagiwara et al. ..... 399/64 X
5,960,231 A * 9/1999 Martinez ..... 399/30

FOREIGN PATENT DOCUMENTS

JP 62-235544 10/1987
JP 06-241996 * 9/1994

* cited by examiner

*Primary Examiner*—Sandra Brase
(74) *Attorney, Agent, or Firm*—Ostrolenk, Faber Gerb & Soffen, LLP

(57) ABSTRACT

The present invention provides a toner concentration measuring apparatus capable of precisely measuring the concentration of toner in a developer and having first and second light guiding devices whose end surfaces project into a duct traversed by developer fluid and a light receiving device for receiving light transmitted from the first light guiding device to the second light guiding device.

16 Claims, 6 Drawing Sheets

TONER CONCENTRATION MEASURING APPARATUS

BACKGROUND OF THE INVENTION

1. Field of the Invention

The present invention related to a toner concentration measuring apparatus that measures the concentration of toner in a developer of an electrostatic copying apparatus.

2. Description of Prior Art

Various electrostatic copying apparatuses, such as a copier, a printer or a facsimile, have been used. These electrostatic copying apparatuses form a latent image on the surface of photosensitive material which is identical with an original image, brings toner-dispersed developer into contact with the surface of this photosensitive material, and sticks toner particles only on the latent image with electrostatic forth to form a copied image on a recording paper. In order to maintain the copy concentration on the recording paper, there are several types of concentration measuring apparatuses for measuring the concentration of the toner in the developer.

Japanese Patent Laid-Open Publication No. Sho 62-235544 (disclosed on Oct. 15, 1987 in Japan) discloses a toner concentration measuring method for electrostatic photography developer.

The publication discloses only the principle of transmittance measurement of infrared rays which are transmitted through the developing layer of wet-type developer. The publication does not disclose its practical configuration.

However, merely applying the above-described principle of the transmittance measurement of the infrared rays through the developer to the copying apparatus with no technical modification added, this technique creates some problems. For example, in a configuration in which the transmittance of the infrared rays through a developer-supplying duct is measured, the problems described below arise.

First, when a plurality of color developers are used for a color printer, a plurality of color toners are sometimes blended in the developer. In such a case, the transmittance of a specific wavelength band is significantly decreased, and an incorrect toner concentration which is higher than the actual concentration is obtained.

Second, the toner particles in the developer are precipitated or stagnated easily in a duct. This results in an incorrect toner concentration that is higher than the actual concentration.

Third, in a configuration in which the transmittance is measured with a light emitting device and a light receiving device across the duct, the attenuation of the transmitting light becomes significantly large because the transmittance of toner-dispersed developer is very low. As a result, the detection sensitivity becomes very low, producing a large measurement error in the measured toner concentration.

Fourth, because the attenuation of the transmitting light is very large in the configuration described in the above-described third problem, a small positioning error in installing the light emitting device and the light receiving device in the duct would results in a large measurement error in the toner concentration.

SUMMARY OF THE INVENTION

The toner concentration measuring apparatus according to the present invention, provided along a duct through which developer containing toner particles is supplied, includes a light emitting device for emitting light; a first light guiding device having an end surface projecting into the duct for guiding the light emitted from the light emitting device; a second light guiding device having an end surface projecting into the duct and opposed to the end surface of the first light guiding device for guiding light emitted from the end surface of the first light guiding device and transmitted through the developer in the duct; and a light receiving device for receiving light transmitted to the second light guiding device.

thus the toner concentration measuring apparatus according to the present invention has a pair of the opposing small-diameter light guiding devices in the duct with a small interval between them to reduce the attenuation of the light transmitted through the developer. This structure allows the concentration of the toner in the developer to be measured precisely.

DETIAILED DESCRIPTION OF THE PREFERRED EMBODIMENTS

Figure 1:
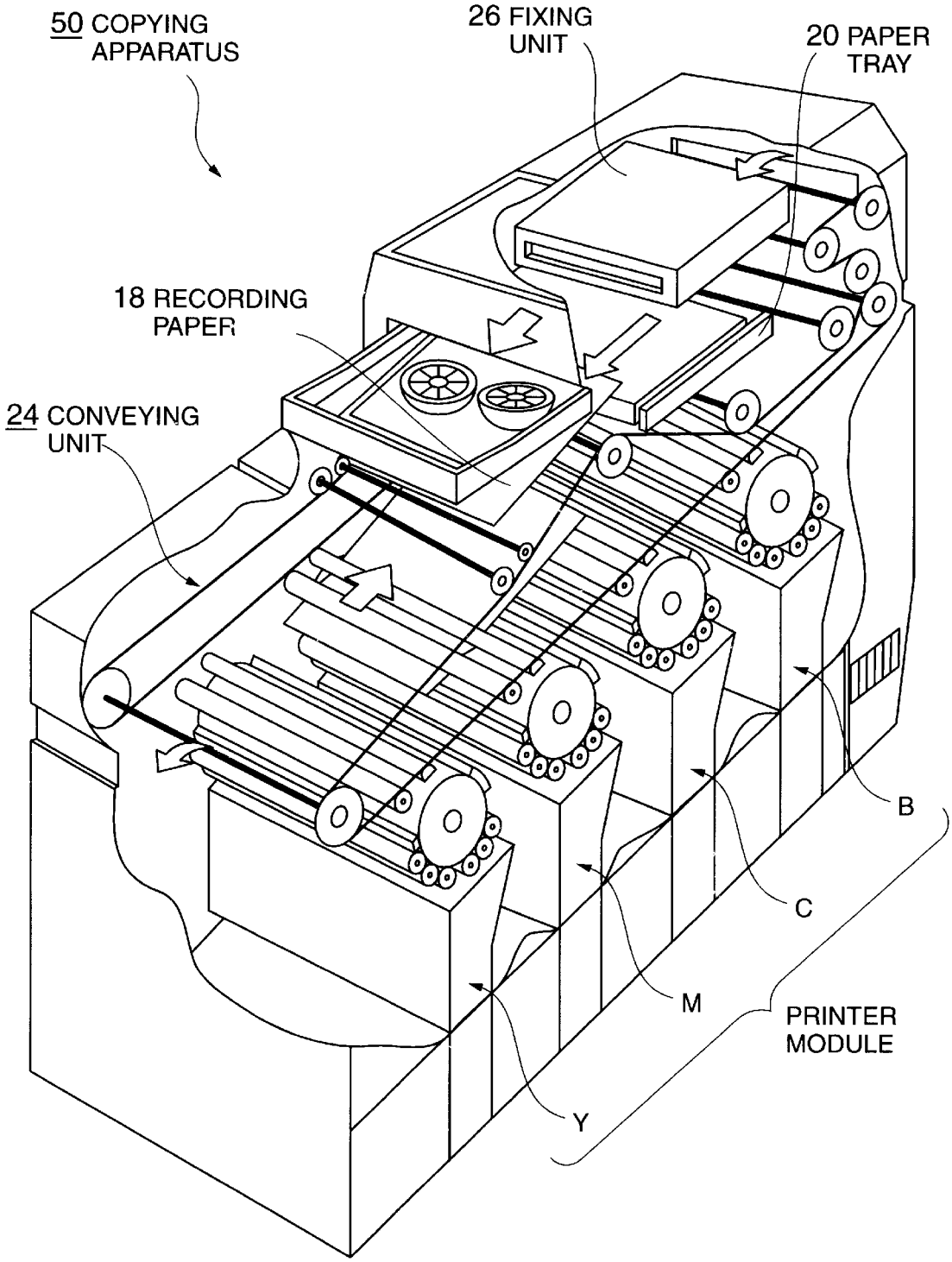
FIG. 1 is a perspective view of a copying apparatus to which a toner concentration measuring apparatus in an embodiment of the present invention is applied.

FIG. 1 is a perspective view of a copying apparatus to which a toner concentration measuring apparatus in an embodiment of the present invention is applied. A copying apparatus 50 shown in FIG. 1, which is electrostatic color copying apparatus such as a copier, a printer or a facsimile, consists of a paper tray 20, a conveying unit 24, printer modules Y, M, C, and B, and a fixing unit 26.

The paper tray 20 stores recording papers 18 therein.

The conveying unit 24 conveys each of the recording papers 18 to a specified position in the paper tray 20, the printer modules Y, M, C, and B, and the fixing unit 26 which are on a conveying route.

Each of the printer modules Y, M, C, and B forms yellow, magenta, cyan, and black images, respectively. They sequentially copy the image onto the surface of the recording paper 18.

The fixing unit 26 fixes the toner particles copied onto the surface of each of the recording papers 18 as it passed sequentially through the printer modules Y, M, C, and B.

Figure 2:
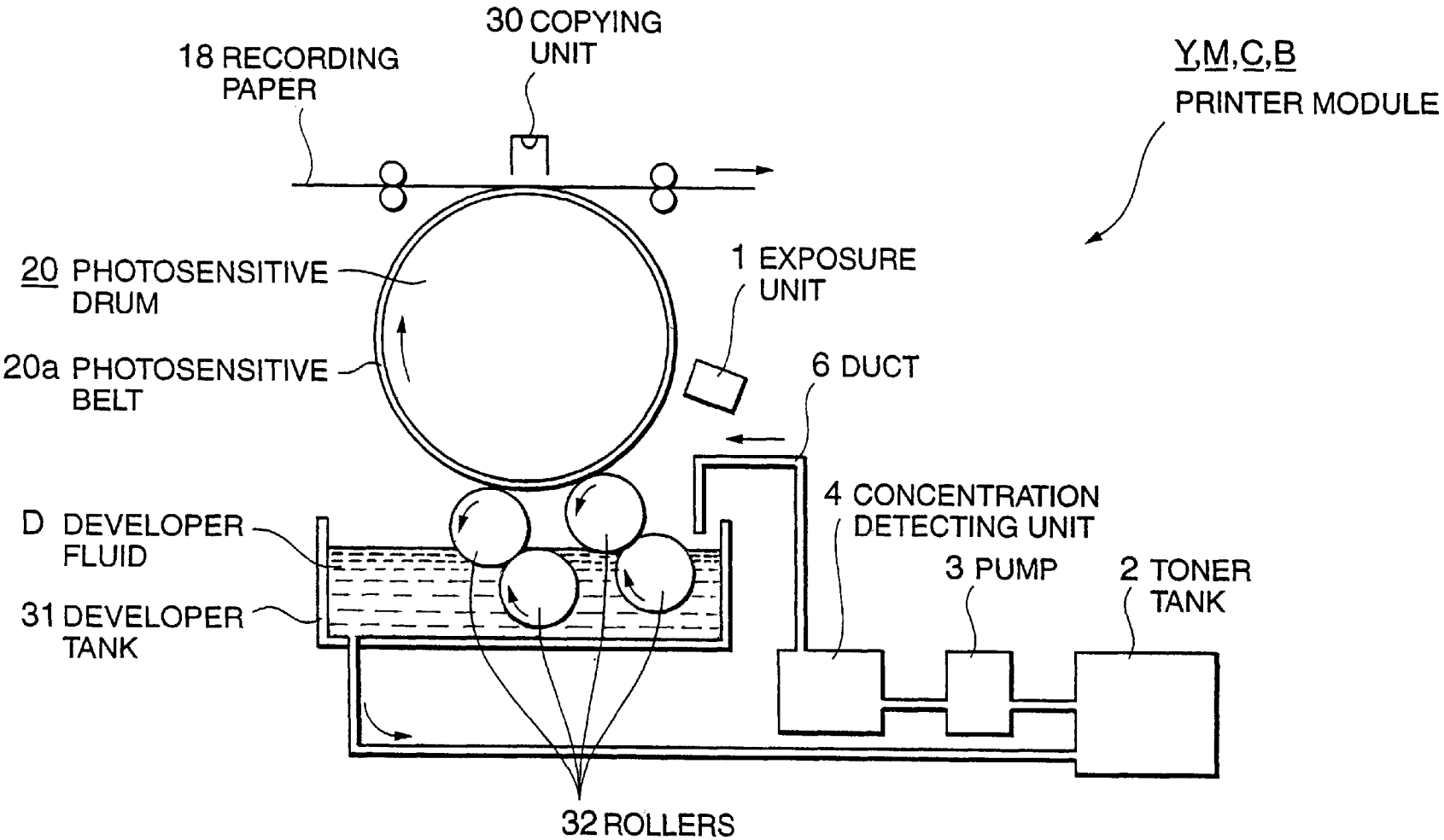
FIG. 2 is a front view of a printer module of the copying apparatus in the FIG. 1 embodiment.

FIG. 2 is a front view of each printer module of the copying apparatus in the FIG. 1 embodiment. Each of the printer modules Y, M, C, and B shown in FIG. 2 consists of a photosensitive drum 20, an exposure unit 1, a developer tank 31, rollers 32, a copying unit 30, a toner tank 2, a pump 3, a concentration detecting unit 4, and a duct 6.

Each of the printer modules y, M, C, and B selectively sticks the charged color toner particles, dispersed in the solvent of the developer D stored in the developer tank 31, onto the photosensitive belt 20*a* and copies the particles onto the recording paper 18.

On the surface of the photosensitive drum 20 is provided a photosensitive belt 20*a* that is a belt like a circulating endless belt.

The exposure unit 1 forms an electrostatic latent image on the surface of the photosensitive belt 20*a*.

The developer tank 31 stores therein a predetermined amount of developer D in which the toner particles of each color are dispersed in solvent.

The rollers 32 are provided in the developer tank 31 with their surfaces in contact with the photosensitive belt 20*a* on the photosensitive drum 20. The developer D stored in the developer tank 31 is applied onto the surface of the photosensitive belt 20*a* to stick the toner particles, stored in the developer D, selectively onto the surface of the photosensitive belt 20*a* in accordance with the latent image.

The copying unit 30 copies the toner particle selectively stuck onto the surface of the photosensitive belt 20*a*, onto the recording paper 18.

The toner tank 2 stores the developer D therein.

The pump 3 supplies the developer D from the toner tank 2 to the developer tank 31.

The concentration detecting unit 4, provided horizontally along the duct 6 connecting the toner tank 2 and the developer tank 31, measures the concentration of the toner in the developer D that flows from the pump 3.

The duct 6 connects the toner tank 2, the pump 3, the concentration detecting unit 4, and the developer tank 31. The developer D flows through the duct 6.

In the above configuration, the developer D stored in the developer tank 31 flows from the toner tank 2 to the pump 3, then to the duct 6, and then back to the toner tank 2.

Figure 3:
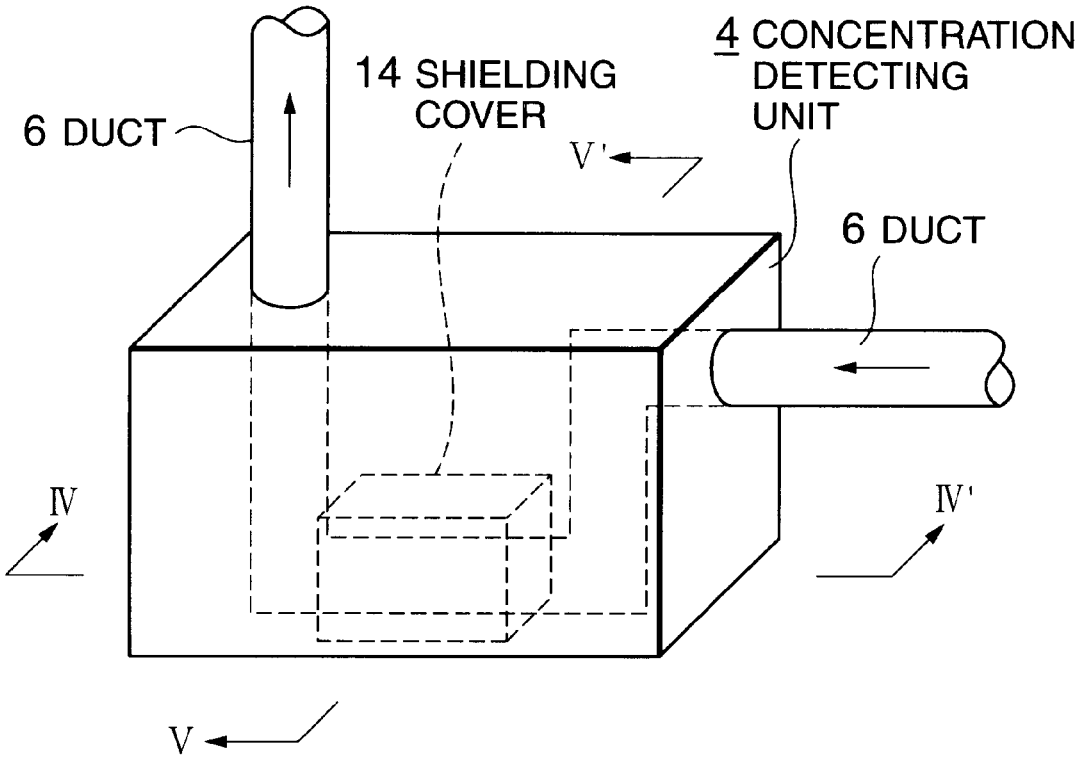
FIG. 3 is a perspective view of the concentration detecting unit of the concentration measuring apparatus in the FIG. 1 embodiment.
Figure 4:
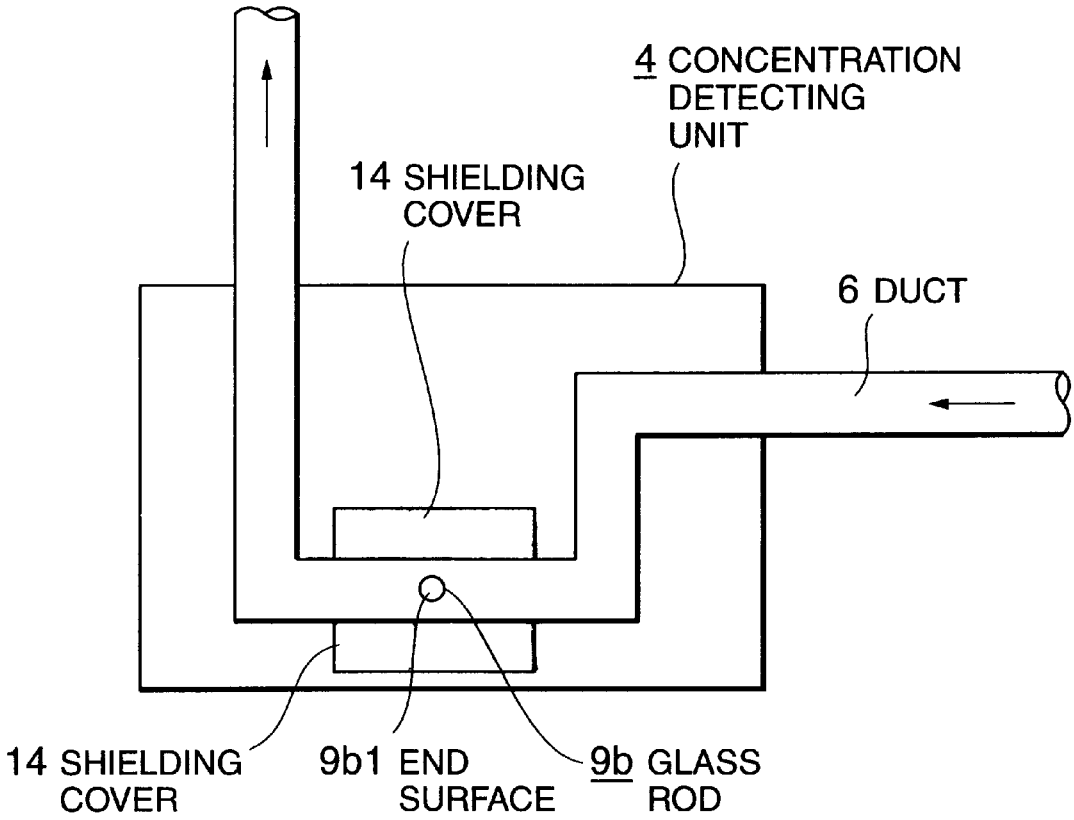
FIG. 4 is a cross-sectional view along the line IV–IV' showing the concentration detecting unit of the concentration measuring apparatus in the FIG. 1 embodiment.
Figure 5:
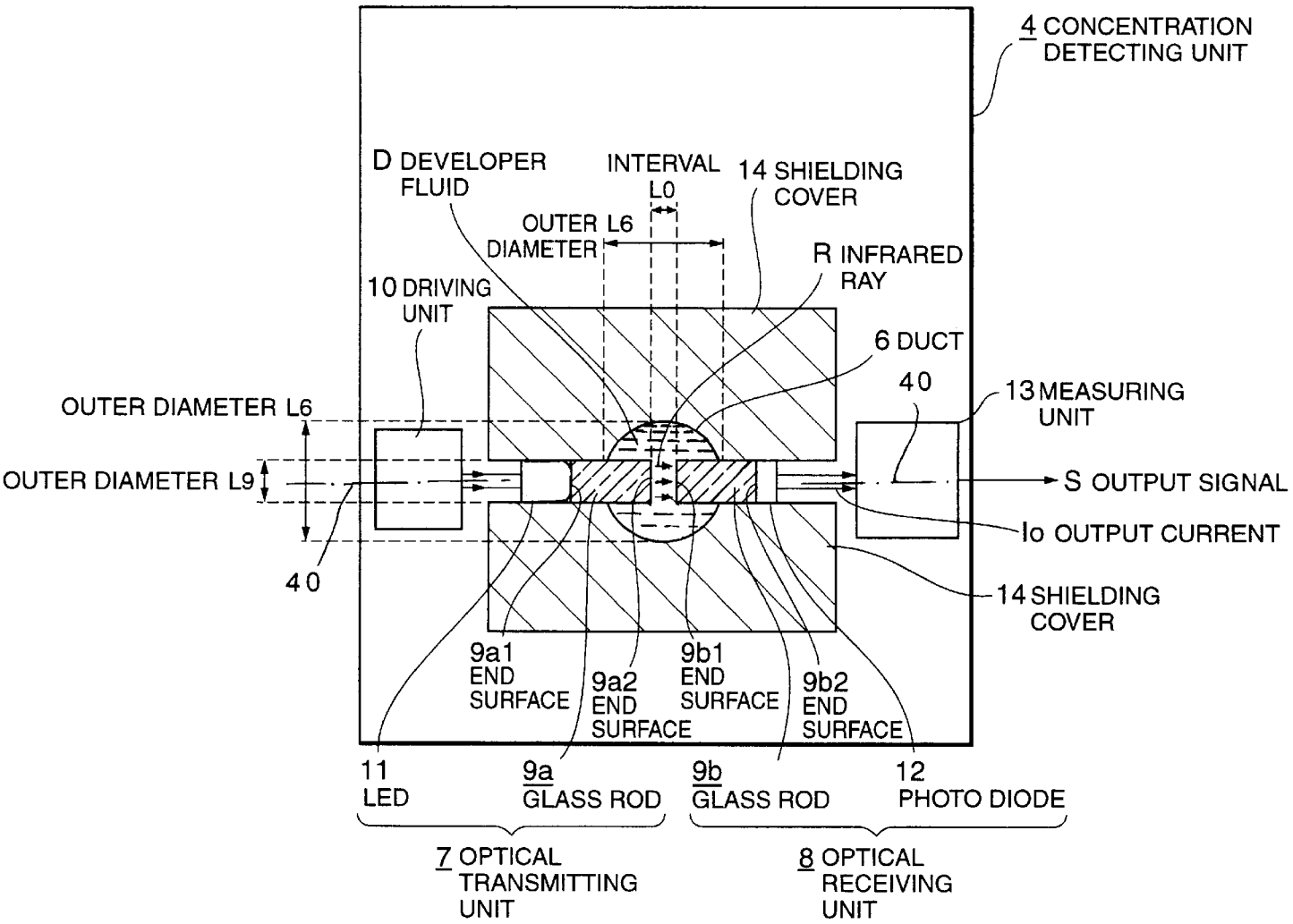
FIG. 5 is a cross-sectional view along the line V–V' showing the concentration detecting unit of the concentration measuring apparatus in the FIG. 1 embodiment.

FIG. 3 is a perspective view of the concentration detecting unit of the concentration measuring apparatus in the FIG. 1 embodiment. FIG. 4 is a cross-sectional view along the line IV–IV' showing the concentration detecting unit of the concentration measuring apparatus in the FIG. 1 embodiment. FIG. 5 is a cross-sectional view along the line V–V' showing the concentration detecting unit of the concentration measuring apparatus in the FIG. 1 embodiment.

As shown in FIGS. 3–5, the concentration detecting unit 4 consists of glass rods 9*a* and 9*b*, an optical transmitting unit 7, a driving unit 10, an optical receiving unit 8, and a measuring unit 13.

The glass rods 9*a* and 9*b* are a pair of coaxial longitudinal guiding devices, each of which extends along a respective axis 40, as shown in FIG. 5. The elongated rods are opposed and project into the developer D across the diametrical cross section of the duct 6 in such a manner that the axes 40 are arranged at right angles to the direction in which the developer D flows.

An outer diameter L9 of the glass rods 9*a* and 9*b* is set smaller than an outer diameter L6 of the duct 6. This configuration significantly reduces the resistance of the glass rods 9*a* and 9*b* to the flow of the developer D in the duct 6.

End surfaces 9*a*2 and 9*b*1 of the glass rods 9*a* and 9*b* are opposed and spaced a predetermined interval Lo apart. This interval Lo is set smaller than the outer diameter L6 of the duct 6. This configuration shortens the interval Lo for which an infrared ray R is transmitted through the developer D and therefore reduces the attenuation of the intensity of the infrared ray R, thus increasing toner concentration measurement precision.

The optical transmitting unit 7 consists of an LED (Light Emitting Diode) 11 and a glass rod 9*a*. The LED 11 is located adjacent to an end surface 9*a*1 of the glass rod 9*a* and emits the infrared ray R along the axis of the glass rod 9*a*. The optical transmitting unit 7 emits the infrared ray R along the diametrical cross section of the duct 6.

A light-emitting device whose emitted-light wavelength band is in the infrared wavelength band is used as the LED 11.

The driving unit 10 turns on and drives the LED 11.

The optical receiving unit 8 consists of a photodiode 12 and the glass rod 9*b*. The photodiode 12 is located adjacent to an end surface 9*b*2 of the glass rod 9*b* and has a light-receiving axis along the axis of the glass rod 9*b*.

The optical receiving unit 8 outputs an output current Io corresponding to the amount of received infrared ray R transmitted from the LED 11 through the developer D.

A light receiving device whose received-light wavelength band is in the infrared wavelength band is used as the photodiode 12. More preferably, a light receiving device whose maximum sensitivity wavelength is in the infrared wavelength band is used.

The measuring unit 13 outputs an output signal S in response to the output current Io from the photodiode 12.

This pair of the glass rods 9*a* and 9*b*, the LED 11, and the photodiode 12 are completely covered by a shielding cover 14 to shield them from external light.

The principle of measurement will be described below.

Each of the printer modules Y, M, C, and B uses each of the developers D dispersed each of the yellow, magenta, cyan, and black toner particles, respectively. The developer D with which color toner is dispersed has the highest absorbency ratio in the wavelength band of 400–500 nm for yellow, 500–600 nm for magenta, and 600–700 nm for cyan.

Because of avoiding the wavelength band in which the absorbency ratio of the developer D of the color becomes highest, the detection sensitivity of the wavelength band of the light transmitted through the developer D may be increased. Note that black is not limited by the wavelength band because its absorbency ratio is constant regardless of the wavelength band.

However, when the developer D of some color gets mixed with the developer D of another color, the absorbency ratio of the developer D greatly varies as described above. For example, when light with the wavelength band of 400–500 nm is used as the transmission light, even if a small amount of yellow toner particles are mixed with the developer D of magenta or cyan, would significantly increase the absorbency ratio of the wavelength band and therefore significantly decreases the amount of the light that is transmitted. As a result, the toner concentration is measured incorrectly. The resulting value is higher than the actual concentration.

The toner concentration measuring apparatus according to the present invention uses light in the infrared wavelength band as the transmission light. The light in the infrared wavelength band has a low absorbency ratio for yellow, magenta, and cyan. Therefore, even if the toner particles of some color are mixed with the developer D of another color, the absorbency ratio does not greatly varies, thereby allowing the toner concentration to be measured precisely.

Figure 6:
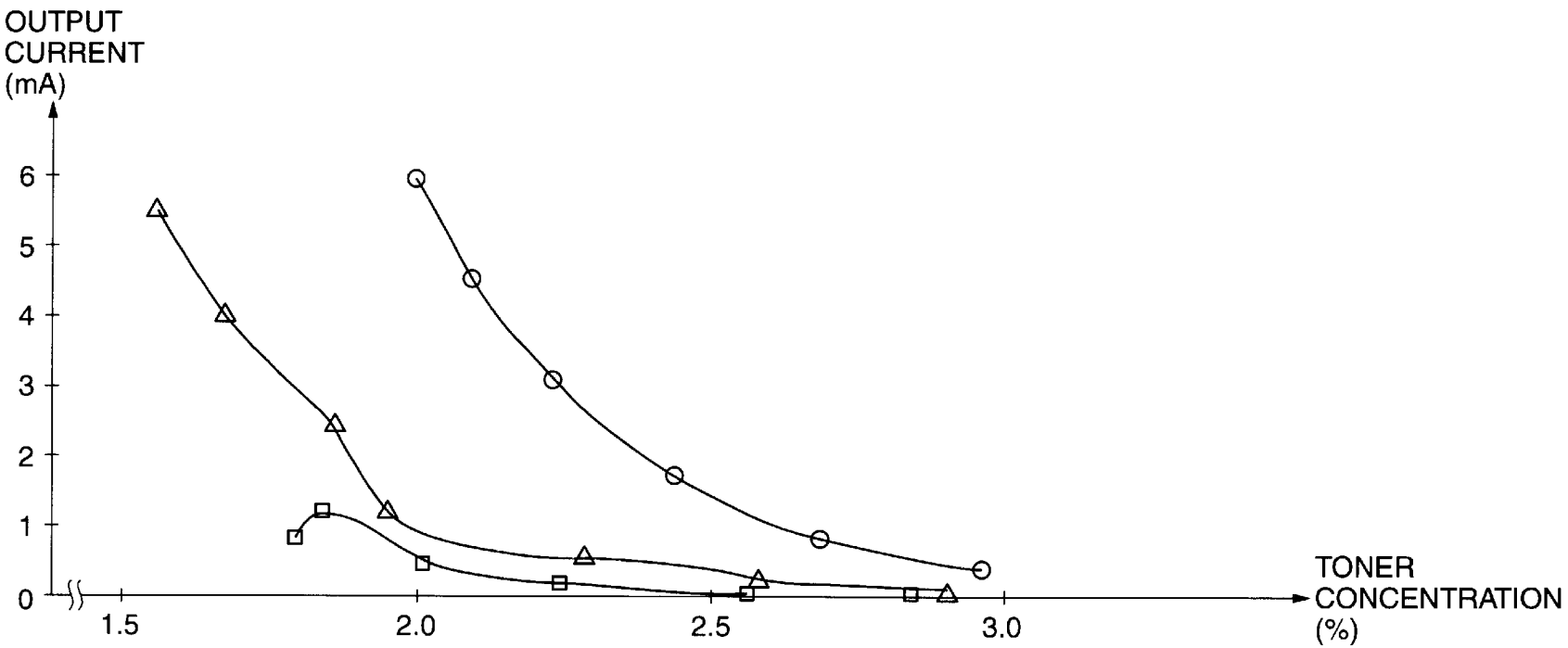
FIG. 6 is a diagram showing the output current versus concentration characteristics of the photodiode in the concentration measuring apparatus in the FIG. 1 embodiment.

FIG. 6 is a diagram showing the output current versus concentration characteristics of the photodiode in the FIG. 1 embodiment. It shows the relation between the output current of the photodiode 12 and the concentration. In FIG. 6, square marks indicate the measuring results when white light is used as the transmission light. Triangular marks indicate the measuring results when red light with the wavelength of 600 nm is used. Circular marks indicate the measuring results when an infrared ray with the wavelength of 850 nm is used.

FIG. 6 shows that the infrared ray indicated by the circular marks is best for measuring the concentration because the linearity of the output current Io from the photodiode 12 is highest.

In addition, the toner concentration measuring apparatus according to the present invention projects a pair of opposing glass rods 9*a* and 9*b* far into the duct 6 to a position near the center of the duct 6 along the diametrical cross section of the duct 6. This configuration minimizes the interval Lo for which transmission light passes the developer D, increasing the toner concentration measurement sensitivity and keeping the toner concentration measurement error to a minimum.

Moreover, projecting the opposing end surfaces 9*a*2 and 9*b*1 of the glass rods 9*a* and 9*b* far into the duct 6 to a position near the center of the duct 6 where the flow rate of the developer D in the duct 6 is highest allows the flowing developer D to clean the end surfaces 9*a*2 and 9*b*1 of the glass rods 9*a* and 9*b*. Therefore, this configuration prevents toner particles from adhering to the end surfaces 9*a*2 and 9*b*1, ensuring high-precision toner concentration measurement.

Measuring the toner concentration near the center of the cross section of the duct 6 prevents a measurement error due to the precipitation or stagnation of toner particles and therefore ensures high-precision toner concentration measurement.

Furthermore, installing the glass rods 9*a* and 9*b* at right angles to the flow of the developer D prevents a measurement error due to the precipitation or stagnation of the toner particles.

In the embodiment above, the infrared ray R is used. For single-color copying apparatus 50, visible rays may be used if the color blend does not occur.

The glass rods 9*a* and 9*b* are used as the light guiding devices in the embodiment. Instead, any light guiding material such as glass or plastic may be used.

The LED 11 is used as a light emitting device in the embodiment. Instead, any light emitting device emitting the infrared rays R, such as a laser diode, may be used.

The photodiode 12 is used as the optical receiving unit in the embodiment. Instead, any optical receiving unit receiving the infrared rays R, such as a photo transistor, may be used.

The toner concentration measuring apparatus according to the present invention uses the light in the infrared wavelength band as the transmitting light as described above. Therefore, the apparatus can measure the toner concentration of the developer precisely even if the color blend occurs.

In addition, projecting the light guiding devices into the duct to arrange them closely shortens the interval for which the transmission light passes the developer, increasing the detection sensitivity.

Projecting the light guiding devices, each with an outer diameter smaller than that of the duct, reduces resistance to the flow of the developer. This configuration reduces measurement errors due to toner precipitation or stagnation and increases the measurement precision.

Moreover, installing the light guiding devices in the duct at right angles to the flow of the developer cleans the end surfaces of the light guiding devices. Therefore, this configuration reduces toner concentration measurement errors caused by toner particle adhesion or precipitation, ensuring high-precision measurement.

Furthermore, transmitting light through the light guiding devices allows the duct from being separated from the optical transmitting unit and the optical receiving unit. This configuration reduces the effect of errors involved in installing the optical transmitting unit and the optical receiving unit, making the installation easier and enhancing productivity.

Because the optical transmitting unit and the optical receiving unit can be used for all colors, there is no need for changing the optical wavelength for each of the colors. Therefore, the concentration measuring apparatus according to the present invention requires fewer types of parts.

What is claimed is:

1. A toner concentration measuring apparatus comprising:

a duct traversed by developer containing toner particles;

a light emitting device for emitting light;

a first light guiding optical rod having an end surface projecting into said duct, for guiding said light emitted from said light emitting device;

a second light guiding optical rod having an end surface projecting into said duct and opposed to said end surface of said first light guiding optical rod, for guiding light emitted from said end surface of said first light guiding optical rod and transmitted through said developer in said duct; and a light receiving device for receiving light transmitted to said second light guiding optical rod.

2. The toner concentration measuring apparatus as defined in claim 1 wherein said light is in an infrared wavelength band.

3. The toner concentration measuring apparatus as defined in claim 1 wherein said light emitting device emits said light in an infrared wavelength band.

4. The toner concentration measuring apparatus as defined in claim 1 wherein said light receiving device receives said light in an infrared wavelength band.

5. The toner concentration measuring apparatus as defined in claim 1 wherein a maximum sensitivity wavelength of said light receiving device is in an infrared wavelength band.

6. The toner concentration measuring apparatus as defined in claim 1, wherein said first light guiding optical rod and said second light guiding optical rod, which are opposed, project into said duct to a position near a center of a diametrical cross section of said duct.

7. The toner concentration measuring apparatus as defined in claim 1, wherein an interval between said first light guiding optical rod and said second light guiding optical rod is smaller than an outer diameter of said duct.

8. The toner concentration measuring apparatus as defined in claim 1, wherein an outer diameter of said first light guiding optical rod and said second light guiding optical rod is smaller than an outer diameter of said duct.

9. The toner concentration measuring apparatus as defined in claim 1, wherein said first light guiding optical rod and said second light guiding optical rod are opposed and arranged at right angles to a flow of said developer flowing through said duct.

10. The toner concentration measuring apparatus as defined in claim 1, wherein said first light guiding optical rod and said second light guiding optical rod project into said duct that is parallel to a horizontal plane.

11. The toner concentration measuring apparatus as defined in claim 1, wherein said first light guiding optical rod and said second light guiding optical rod are made of glass.

12. The toner concentration measuring apparatus as defined in claim 1, wherein said first light guiding optical rod and said second light guiding optical rod are made of plastic.

13. The toner concentration measuring apparatus as defined in claim 1, wherein said first light guiding optical rod, said second light guiding optical rod, said light emitting device, and said light receiving device are covered with a shielding cover shielding from external light.

14. A toner concentration measuring apparatus comprising:

a housing traversed by developer fluid flowing along a path; and first and second elongated, light guiding elements mounted coaxially with one another to said housing and extending transversely to said path toward one another for guiding and transmitting light, respectively.

15. A toner according to claim 14, wherein the housing is a duct having an annular cross-section, said first and second elongated light guide elements being first and second optical rods whose outer diameter is smaller than a diameter of said duct, said first and second optical rods having first and second inner ends, respectively, facing one another and spaced apart in said duct at a distance less than said diameter of said duct.

16. A toner according to claim 14, wherein said first and second light guiding elements lie in a plane extending perpendicular to said path.

* * * * *